US006280214B1

(12) United States Patent
Chang

(10) Patent No.: US 6,280,214 B1
(45) Date of Patent: Aug. 28, 2001

(54) RADIO FREQUENCY ELECTRICAL CONNECTOR

(75) Inventor: Yao Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/492,984

(22) Filed: Jan. 27, 2000

(30) Foreign Application Priority Data

Jan. 18, 2000 (TW) ..... 89100769

(51) Int. Cl.[7] ..... H01R 29/00
(52) U.S. Cl. ..... 439/188; 439/488; 200/51.1
(58) Field of Search ..... 439/188, 488, 439/489, 63; 200/51.09, 51.1

(56) References Cited

U.S. PATENT DOCUMENTS 3,949,180 * 4/1976 Ojima et al. ..... 200/51.1
4,725,241 * 2/1988 Bertini et al. ..... 439/188
4,804,339 * 2/1989 Cohen ..... 439/188
6,099,334 * 8/2000 Togashi ..... 439/188

* cited by examiner

*Primary Examiner*—Hien Vu
(74) *Attorney, Agent, or Firm*—Wei Te Chung

(57) ABSTRACT

An RF electrical connector comprises an insulative housing with a low-profile body section, a conductive shell enclosing the housing, a fixed contact and a switch contact. Both the switch contact and the fixed contact are retained in the housing in a normally-closed configuration and electrically contact with one another. The switch contact comprises a retaining body and a folded contacting arm extending therefrom which has a first portion extending upward from the retaining body, a curved portion extending from the first portion and providing enough resilience during mating and a second portion extending downward from the curved portion. The second portion comprises an apex for contacting a plug contact of a mating plug connector and a contacting end for contacting the fixed contact.

2 Claims, 3 Drawing Sheets

RADIO FREQUENCY ELECTRICAL CONNECTOR

BACKGROUND OF THE INVENTION

The present invention relates to a radio frequency (RF) connector, and particularly to an RF connector having an electrical switch which can be safely engaged with a plug contact thereof.

Today, the density of electrical elements in a computer is getting higher and higher, so electrical elements received therein, such as RF connectors, must be effectively designed so as to make the best of the limited space within the computer. A conventional RF connector comprises an insulative cylindrical housing having a body section, which has a fairly high profile, a conductive shield enclosing the housing, and a switch contact and a fixed contact, both of which are retained in the housing, and in their normally closed state, contact with one another. The switch contact comprises a resilient cantilever contacting arm extending upwardly and being received in the body section of the housing. However, if the height of the body section of the housing is reduced, the cantilever arm of the switch contact must be correspondingly reduced which results in the contacting arm not having enough resilience to safely support mating between the contacting arm and a plug contact of a plug connector. As a result, the contacting arm can be easily deformed, thereby, adversely affecting the conductive contact.

Hence, an improved RF electrical connector is required to overcome the disadvantages of the prior art.

BRIEF SUMMARY OF THE INVENTION

An essential object of the present invention is; to provide an RF switch connector having a folded switch contact which can be safely connected with a plug contact of a mating plug.

An RF electrical connector of the present invention comprises an insulative housing with a low-profile body section, a fixed contact and a switch contact both of which are retained in the housing and contact with one another, and a conductive shield enclosing the housing. The switch contact comprises a retaining body and a folded contacting arm extending therefrom which has a first portion extending upward from the retaining body, a curved portion extending from the first portion and providing enough resilience during mating and a second portion extending downward from the curved portion. The second portion comprises an apex contacting a plug contact of a plug and a contacting end contacting the fixed contact.

DETAILED DESCRIPTION OF THE INVENTION

Figure 1:
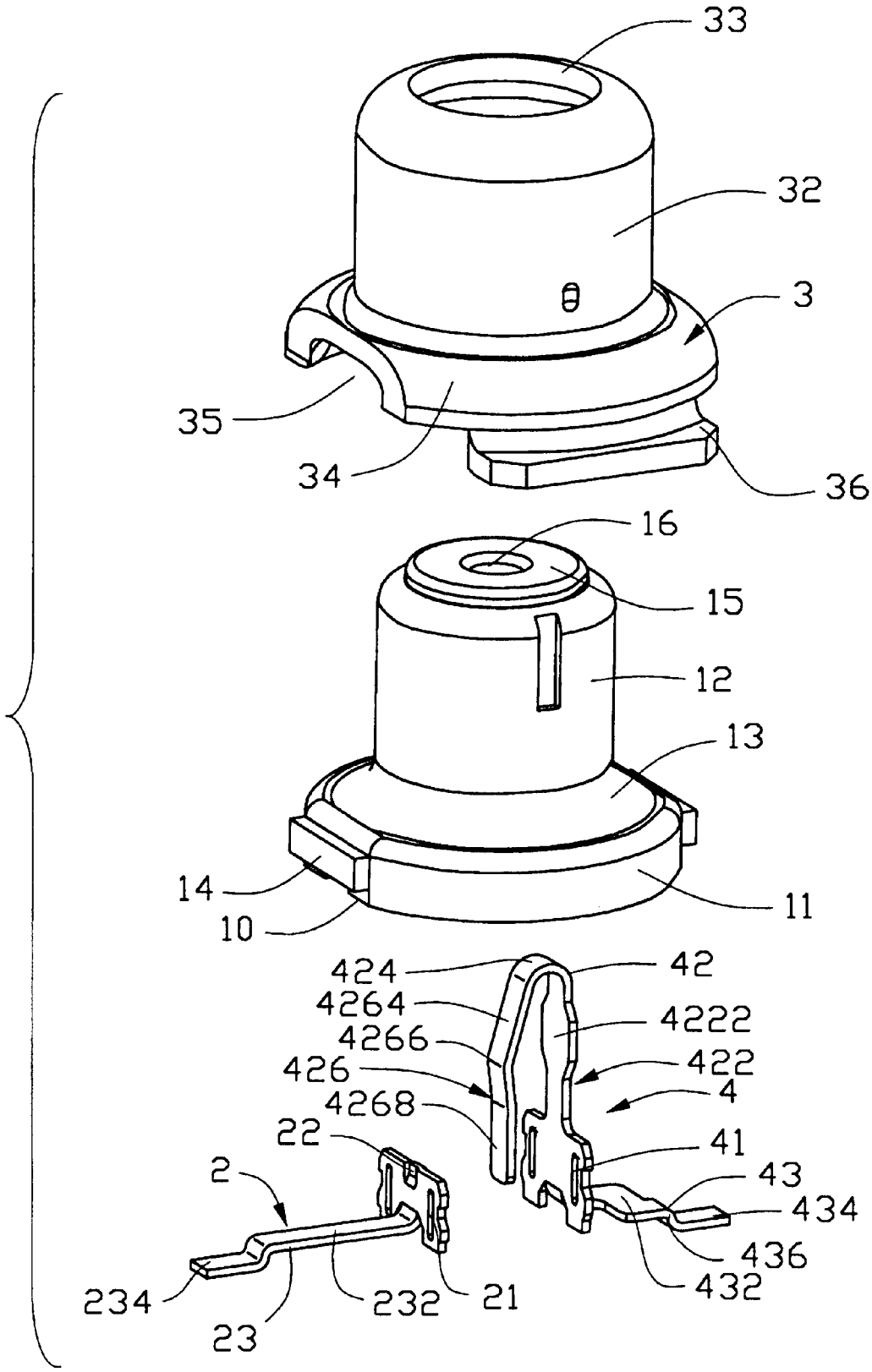
FIG. 1 is an assembled view of an RF electrical connector of the present invention.

Referring to FIGS. 1 through 4, an RF switch connector of the present invention comprises an insulative housing 1 generally cylindrical in shape, a fixed contact 2 retained in the insulative housing 1, a switch contact 4 contacting the fixed contact 2, and conductive shield 3 enclosing the housing 1.

Figure 2:
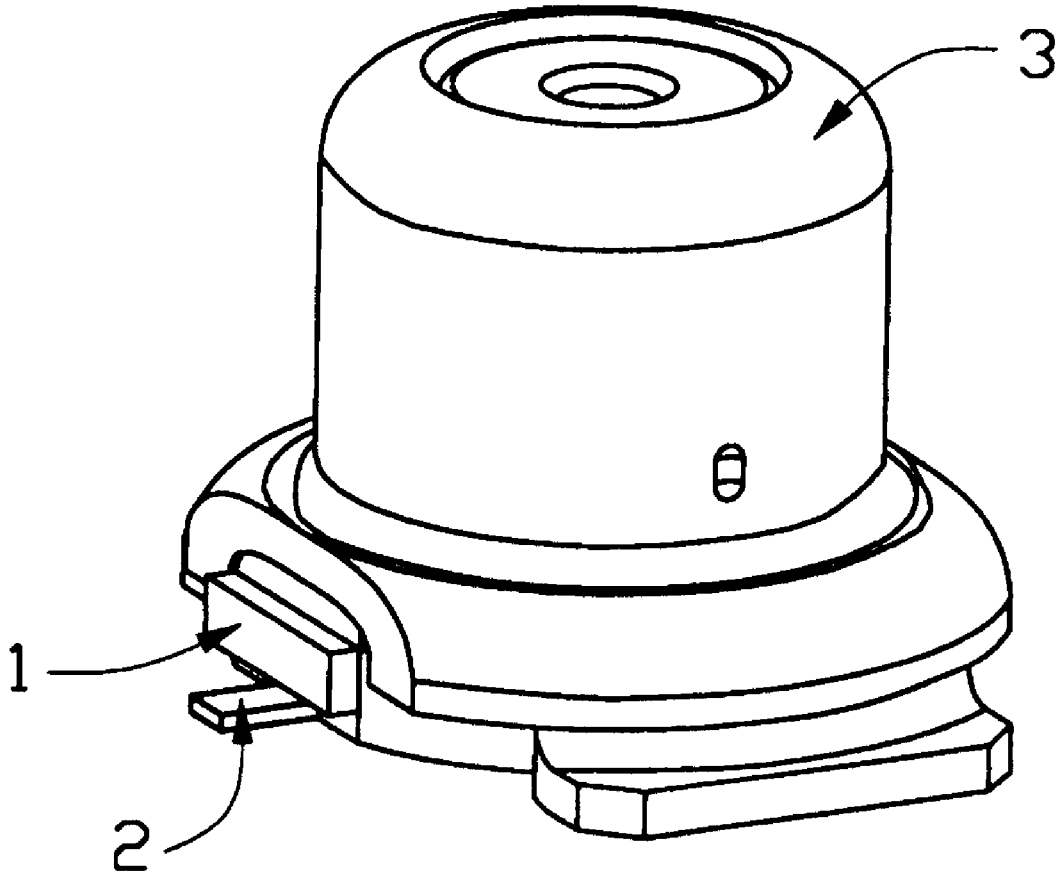
FIG. 2 is an exposed view of FIG. 1.

Referring to FIG. 2, the insulative housing I comprises a circular base 11, a cylindrical low-profile body section 12 extending upward therefrom and an inclined section 13 therebetween. A pair of retaining protrusions 14 extends laterally from diametrically opposite sides of the circular base 11 and a receiving channel (not shown) is defined therein. The body section 12 comprises a top portion 15 which has a smaller diameter than a lower portion thereof. A through hole 16 extends, from a top surface to a bottom surface 10 of the housing 1 for the insertion of a plug contact 54 of a plug connector 5 (referring to FIGS. 3 and 4). A cavity 19 is formed beside the through hole 16 for receiving the switch contact 4 which will be illustrated in detail later.

The conductive shield 3 has a shape corresponding to the housing 1 and comprises a base 34 and a bulb portion 32 respectively enclosing the circular base 11 and the body section 12 of the insulative housing 1. The base 34 defines a pair of notched portions 35 at a diametrically opposite sides thereof for receiving the pair of retaining protrusions 14 of the housing 1. A pair of diametrically opposite flanges 36 extend from the base 34 along an axis perpendicular to the axis of the notched portions 35 for mounting to a printed circuit board (not shown). Additionally, the bulb portion 32 defines an opening 33 in a top surface thereof corresponding to the top portion 15 of the housing 1.

The present invention is embodied in the switch contact 4 which provides enough resilience and rigidity for safely fulfilling the switch function in cooperation with the fixed contact 2 and the mating plug connector 5. The switch contact 4 comprises a vertical retaining body 41, a folded contacting arm 42 extending upwardly from an upper edge thereof and a mounting leg 43 extending laterally from the other end thereof. The folded contacting arm 42 comprises a first portion 422 extending upwardly from the retaining body 41, a second portion 426 extending downwardly with respect to the first portion and a curved portion 424 connecting the first portion 422 and the second portion 426. The first portion 422 comprises a widened portion 4222 connecting with the curved portion 424 at an upper end thereof and is retained upon an inner surface (not labeled) of the through hole 16 of the housing 1. The curved portion 424 is semi-circular in shape and provides ample spring for mating. The second portion 426 comprises an inclined guiding portion 4264 extending downwardly and outwardly from the curved portion 424 for facilitating an insertion of the mating plug contact 54 of the plug connector 5, a contacting end 4268 extending inwardly and downwardly with respect to the guiding portion 4264 and an apex 4266 between the guiding portion 4264 and the contacting end 4268. The mounting leg 43 comprises an engaging portion 432 for engaging with one portion of the receiving channel of the housing 1, an exposed lower portion 434 for mounting to the printed circuit board and a step 436 therebetween.

The fixed contact 2 and the plug 5 electrically connect the switch contact 4 in sequence. The fixed contact 2 comprises a vertical retaining body 21 forming a contacting tab 22 at an upper middle portion thereof and a mounting leg 23 extending laterally therefrom and opposite to the mounting leg 43 of the switch contact 4. The mounting leg 23 has a structure similar to the mounting leg 43 of the switch contact 4 for engaging with the other portion of the receiving channel of the housing 1.

Figure 3:
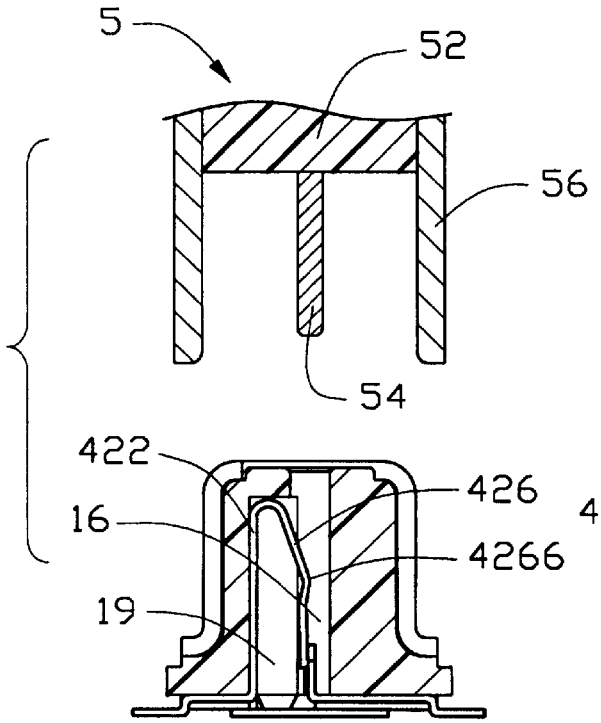
FIG. 3 is a sectional view of an RF electrical connector of the present invention and a plug connector for mating with the RF connector.

Referring to FIG. 3, the plug 5 has a cylindrical shape and comprises a housing 52, a plug contact 54 partially received therein and depending downward therefrom and a conductive shield 56 enclosing the housing 52 and the plug contact 54.

Figure 4:
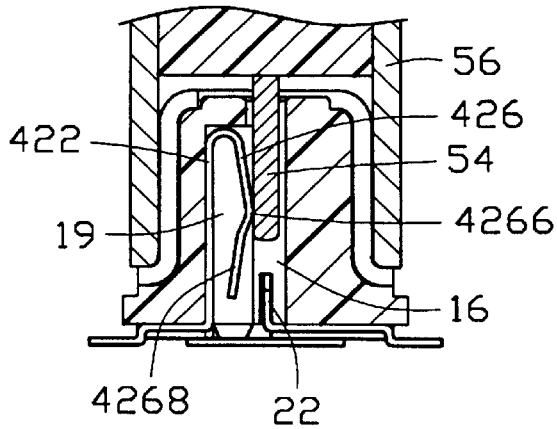
FIG. 4 is the view of FIG. 3 but with connectors mated.

Referring to FIG. 4, in assembly, the fixed contact 2 and the switch contact 4 are inserted into the through hole 165 of the housing 1, wherein an engaging portion 232 and the engaging body 432 fit in the enlarged recess (not labeled) of the housing 1, the contacting tab 21 of the fixed contact 2 contacts the contacting end 428 of the switch contact 4 and an exposed portions 234 of the fixed contact 2 and the lower portion 434 of the switch contact 4 extend out of the housing 1 (referring to FIG. 3). The conductive shield 3 encloses the dielectric housing 1 with the notched recesses 35 thereof engaging with the retaining protrusions 14. Referring to FIG. 4, in uses, the plug 5 is inserted through the opening 33 of the shield 3 into the through hole 16 of the housing 1 and then contacts the guiding portion 4264 and finally contacts the apex 4266 of the switch contact 4, separating the switch contact 4 from the fixed contact 2, thereby fulfilling the switch function of the RF connector.

It is noted that in this embodiment, the horizontal engaging portion 232 of the fixed contact 2 is longer than the horizontal engaging portion 432 of the switch contact 4, while the switch contact 4 includes an additional folded contacting arm 42 extending in the vertical directions in comparison with the fixed contact 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing comprising a body section, a base and an inclined section which connects between the body section and the base, and a through hole extending from a top portion of said body section to a bottom surface of said base with a cavity positioned aside;

a fixed contact having a first vertical retaining body secured in the through hole of the insulative housing and a mounting leg extending laterally from a lower end of the first vertical retaining body, the first vertical retaining body forming a contacting tab at an upper portion thereof;

a switch contact having a second vertical retaining body secured in the cavity of the insulative housing, a folded contacting arm integrally and resiliently extending from an upper end of the second vertical retaining body, and a mounting leg extending outwardly from a lower end of the second vertical retaining body, the folded contacting arm including a first portion extending upward, a curved portion extending from the first portion and a second portion extending downward from the curved portion, the second portion forming a contacting end in contact with the contacting tab of the fixed contact when said plug connector is not received in the through hole and an apex on said second portion for contacting a plug contact of the plug connector when said plug connector is received in the through hole; and a conductive shield enclosing the body section and partially the base of the insulative housing.

2. The electrical connector as claimed in claim 1, wherein the first portion comprises a widened portion retained in an inside wall of the through hole of the housing.

* * * * *